US007038650B2

(12) United States Patent
Tsutsui

(10) Patent No.: US 7,038,650 B2
(45) Date of Patent: May 2, 2006

(54) DISPLAY DEVICE

(75) Inventor: Yusuke Tsutsui, Hashima (JP)

(73) Assignee: Sanyo Electric Co., Ltd., Osaka (JP)

( * ) Notice: Subject to any disclaimer, the term of this patent is extended or adjusted under 35 U.S.C. 154(b) by 176 days.

(21) Appl. No.: 10/120,141

(22) Filed: Apr. 11, 2002

(65) Prior Publication Data

US 2002/0158858 A1 Oct. 31, 2002

(30) Foreign Application Priority Data

Apr. 11, 2001 (JP) ..... 2001-112724

(51) Int. Cl.
*G09G 3/36* (2006.01)

(52) U.S. Cl. ..... 345/98; 345/99; 345/204

(58) Field of Classification Search ..... 345/87–92, 345/98–100, 204, 205, 211–213, 206, 55
See application file for complete search history.

(56) References Cited

U.S. PATENT DOCUMENTS 5,712,652 A 1/1998 Sato et al.
5,790,090 A 8/1998 Libsch et al.
5,945,972 A * 8/1999 Okumura et al. ..... 345/98
5,952,991 A 9/1999 Akiyama
5,977,940 A 11/1999 Akiyama et al.
6,023,308 A 2/2000 Takemura
6,072,454 A 6/2000 Nakai et al.
6,144,354 A * 11/2000 Koyama et al. ..... 345/98
6,333,737 B1 * 12/2001 Nakajima ..... 345/205

FOREIGN PATENT DOCUMENTS

| | | |
|---|---|---|
| EP | 0 797 182 | 9/1997 |
| EP | 1 020 840 | 7/2000 |
| JP | 58-23091 | 2/1983 |
| JP | 08-194205 | 7/1996 |
| JP | 09-236823 | 9/1997 |
| JP | 2001-242819 | 9/2001 |
| KR | 1998-060007 | 10/1998 |

* cited by examiner

*Primary Examiner*—Xiao Wu
(74) *Attorney, Agent, or Firm*—Morrison & Foerster LLP

(57) ABSTRACT

A display device, under a digital display mode, performs writing of digital image signals into a static memory circuit while a power voltage of about 3V is applied to the static memory with a panel drive frequency reduced from 60 Hz to 20–30 Hz. It is thus possible to output the digital image signal from a frame memory directly to a liquid crystal display panel without using a level shifter.

6 Claims, 5 Drawing Sheets

DISPLAY DEVICE

BACKGROUND OF THE INVENTION

1. Field of the Invention

This invention relates to a display device, specifically to a display device which is incorporated into a portable communication and computing device.

2. Description of the Related Art

There has been a great demand in the market for portable communication and computing devices such as a portable TV and a cellular phone. All these devices need a small, light-weight and low-power consumption display device, and efforts have been made accordingly.

FIG. 5 shows a circuit diagram corresponding to a single pixel element of a conventional liquid crystal display device. A gate signal line 51 and a drain signal line 61 are placed on an insulating substrate (not shown) perpendicular to each other. A thin-film transistor (TFT) 72 connected to two signal lines 51, 61, is formed near the intersection of the two signal lines 51, 61. A source 11*s* of the TFT 65 is connected to a display electrode 80 of a liquid crystal 21.

A storage capacitor element 85 holds the voltage of the display electrode 80 during one field period. One terminal 86 of the storage capacitor 85 is connected to the source 11*s* of the TFT 72 and the other terminal 87 is provided with a voltage common among all the pixel elements.

When a scanning signal is applied to the gate signal line 51, the TFT 72 turns to an on-state. Accordingly, an analog image signal from the drain signal line 61 is applied to the display electrode 80, and the storage capacitor 85 holds the voltage. The voltage of the image signal is applied to the liquid crystal 21 through the display electrode 80, and the liquid crystal 21 aligns in response to the applied voltage for providing a liquid crystal display image.

Therefore, this configuration is capable of showing both moving images and still images. There is a need for the display to show both a moving image and a still image within a single display. One such example is to show a still image of a battery within an area of a moving image of a cellular phone display to show the remaining amount of the battery power.

However, the configuration shown in FIG. 6 requires continuous rewriting of each pixel element with the same image signal at each scanning in order to provide a still image. This is basically to show a still-like image in a moving image mode, and the scanning signal needs to activate the TFT 72 at each scanning.

Accordingly, it is necessary to operate a driver circuit which generates a driver signal for the scanning signals and the image signals, and an external LSI which generates various signals for controlling the timing of the driver circuit, resulting in a significant electric power consumption. This is a considerable drawback when such a configuration is used in a cellular phone device which has only a limited power source. That is, the time a user can use the telephone under one battery charge is considerably decreased.

Japanese Laid-Open Patent Publication No. Hei 8-194205 discloses another configuration for a display device suitable for portable applications. This display device has a static memory for each of the pixel elements, as shown in FIG. 6. A static memory, in which two inverters INV1 and INV2 are positively fed back to each other, holds the image signal. This results in reduced power consumption.

In this configuration, a switching element 24 controls the resistance between a reference line and a display electrode 80 in response to the divalent digital image signal held by the static memory in order to adjust the biasing of the liquid crystal 21. The common electrode, on the other hand, receives an AC signal Vcom. Ideally, this configuration does not need to refresh the memory when the image stays still for a period of time.

As described above, the conventional liquid crystal display device is suitable for displaying a full color moving picture in response to the analog image signal. On the other hand, the liquid crystal display device with a static memory for retaining the digital image signal is suitable for displaying a still picture with low-depth and low-energy consumption.

However, the two liquid crystal display devices described above have different sources for image signals. Thus, it is impossible to have both images within a single display device.

SUMMARY OF THE INVENTION

The invention provides a display device including a display panel and an image memory outputting a digital image signal. A plurality of pixel elements are disposed in the display panel. A plurality of static memory circuits are disposed for the corresponding pixel elements. The device has a panel drive circuit supplying a panel drive signal for controlling a timing of writing the digital image signal into the static memory circuits. In this configuration, an image is displayed based on the digital image signal retained in the static memory circuits, and the digital image signal is written into the static memory circuits from the image memory by reducing the frequency of the panel drive signal without a use of a level-shifter for raising the level of the digital image signal.

The invention also provides a display device including a display panel and an image memory outputting a digital image signal. The device also has a DA converter converting the digital image signal outputted from the image memory into an analog image signal and a signal selection element selecting the analog image signal from the DA converter or the digital image signal outputted from the image memory. The selected signal is supplied to the display panel. A timing control circuit supplies a panel drive signal to the display panel. A plurality of pixel elements are disposed in the display panel. A plurality of first display circuits are disposed for the corresponding pixel elements and display an analog image in response to the analog image signal inputted based on the panel drive signal. A plurality of second display circuits are disposed for the corresponding pixel elements and display a digital image in response to the digital image signal. Each of the second display circuits has a static memory circuit which receives the digital image signal based on the panel drive signal. In this configuration, the first display circuit or the second display circuit is selected for displaying the analog image or the digital image, respectively, and the timing control circuit reduces the frequency of the panel drive signal so that the digital image signal is written into the static memory circuit from the image memory without use of a level-shifter for raising the level of the digital image signal.

DETAILED DESCRIPTION OF THE INVENTION

This invention is directed to a display device, which can alternate between two kinds of display modes, an analog display mode and a digital display mode, as described in commonly owned copending U.S. patent application Ser. No. 09/953,233, entitled "DISPLAY DEVICE AND ITS CONTROL METHOD." The disclosure of U.S. patent application Ser. No. 09/953,233 is, in its entirety, incorporated herein by reference.

Based on a display mode switching signal, the liquid crystal display panel receives either an analog image signal or a digital image signal. Under an analog display mode, the analog image signal is inputted into the first display circuit having a storage capacitance element. Under a digital display mode, the digital image signal is written into a static memory disposed for each of the display pixel elements in the liquid crystal display panel. In this configuration, an amplifier for amplifying the amplitude of these signals is required and the amplified signals are supplied to the liquid crystal display panel.

Figure 7:
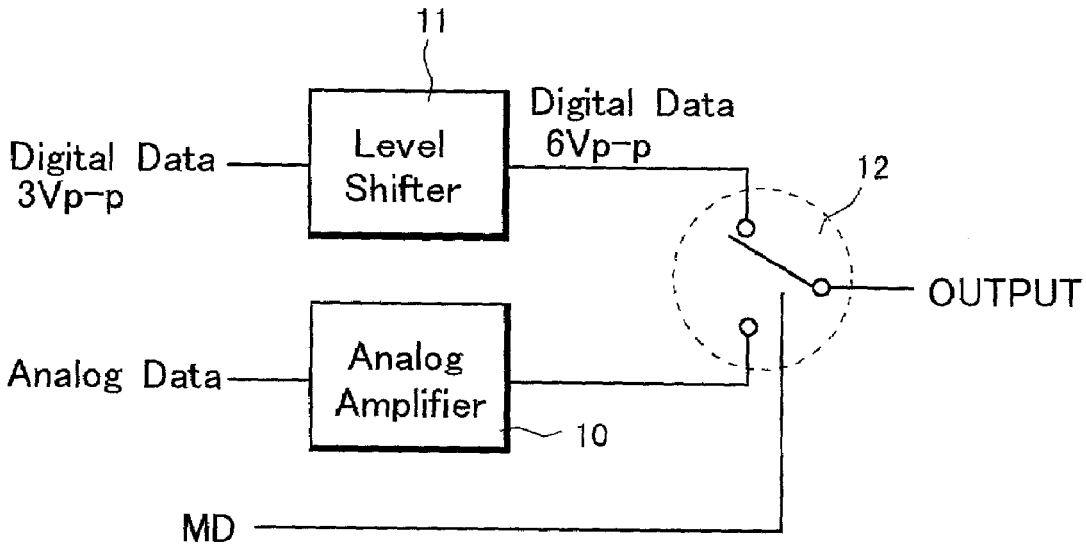
FIG. 7 is a block chart of an amplifier of a liquid crystal display device which forms a basis of this invention.

In FIG. 7 shows a configuration of such an amplifier. The analog amplifier 10 amplifies the inputted analog image signal. The level shifter 11 raises the amplitude of the inputted digital image signal. Usually, the inputted digital image signal has a voltage amplitude of 3 Vp-p. However, about 6V is required as a source voltage of the static memory circuit in order for the digital image signal to be written into the static memory circuit disposed for each of the pixel elements in the liquid crystal display panel under an ordinary panel driver frequency (60 Hz). Therefore, the level shifter, which raises the voltage amplitude of the inputted digital image signal (3 Vp-p) to about 6V, is required.

Then, the switching element 12 is switched based on the display mode switching signal MD. Therefore, under the ordinary display mode (analog display mode), the analog image signal amplified by the analog amplifier 10 is outputted to the liquid crystal display panel. Under the digital display mode, the digital image signal amplified by the level shifter 11 is outputted to the liquid crystal display panel.

Figure 1:
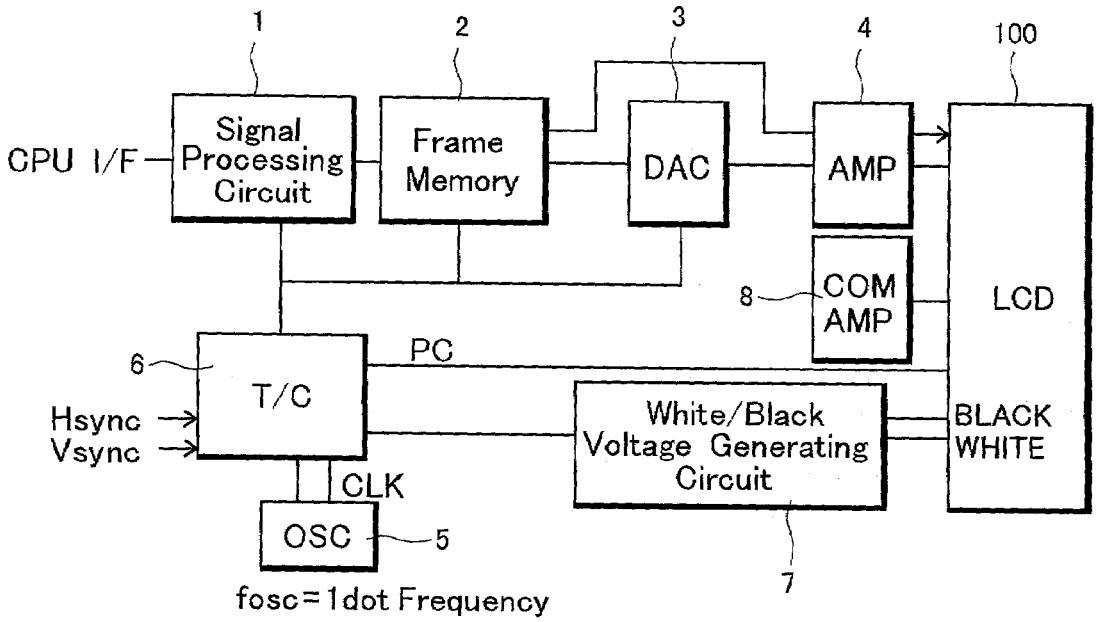
FIG. 1 is a circuit block chart of a liquid crystal display device of an embodiment of this invention.

FIG. 1 shows a circuit block chart of a display device of an embodiment of this invention.

The signal processing circuit 1 performs the various signal processing tasks such as contrast adjustment and brightness adjustment for a digital image signal inputted through a CPU interface. The processed digital image signal is temporarily stored in the frame memory 2. The frame memory 2 is one type of image memory and comprises DRAM or flash memory.

Image signals outputted at a certain timing from the frame memory 2 are converted into the analog image signals by the DA converter 3, and then inputted to the amplifier 4.

Figure 2:
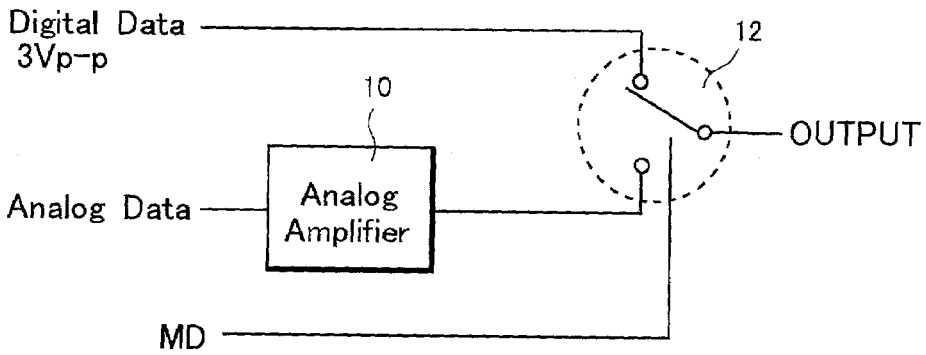
FIG. 2 is a block chart of the amplifier 4 of FIG. 1.

As seen in FIG. 2, the analog amplifier 10 disposed in the amplifier 4 amplifies the analog image signal. On the other hand, the digital image signal (voltage amplitude 3 Vp-p) outputted from the frame memory 2 is directly inputted to a switch 12 without passing through a level shifter. The switch 12 performs the switching based on a display mode-switching signal MD.

Therefore, under the normal display mode (analog display mode), the analog image signal amplified by the analog amplifier 10 is outputted to the liquid crystal display panel 100, and under the digital display mode, the digital image signal with the voltage amplitude of 3 Vp-p is outputted to the liquid crystal display panel 100.

The timing control circuit 6 outputs control signals for controlling the panel drive signal PC, signal processing circuit 1, frame memory 2, and DA converter 3 based on the system clock CLK, horizontal synchronization signal Hsync and the vertical synchronization signal Vsync from the oscillator 5.

In the configuration of FIG. 7, in order to write the digital image signal into a static memory disposed for each of the display pixel elements of the liquid crystal display panel 100 under the ordinary panel drive frequency (60 Hz), 6V is necessary as the power voltage of the static memory circuit. The level shifter 11 is needed for this purpose. A panel drive frequency is a frequency of the sampling pulse, as described later.

However, in this embodiment, by reducing the panel drive frequency from 60 Hz to 20–30 Hz, a power voltage of about 3 V can be used to write a digital signal in the static memory. Therefore, the digital image signal outputted form the frame memory 2 can be directly outputted to the liquid crystal display panel 100 without passing through a level shifter.

As shown in FIG. 1, a white/black voltage generating circuit 7, based on the signal from the timing control circuit 6, outputs the white signal (signal A, as described later) and the black signal (signal B, as described later) to the liquid crystal display panel 100. Also, the reference numeral 8 denotes the amplifier that amplifies the common electrode drive signal of the liquid crystal.

Figure 3:
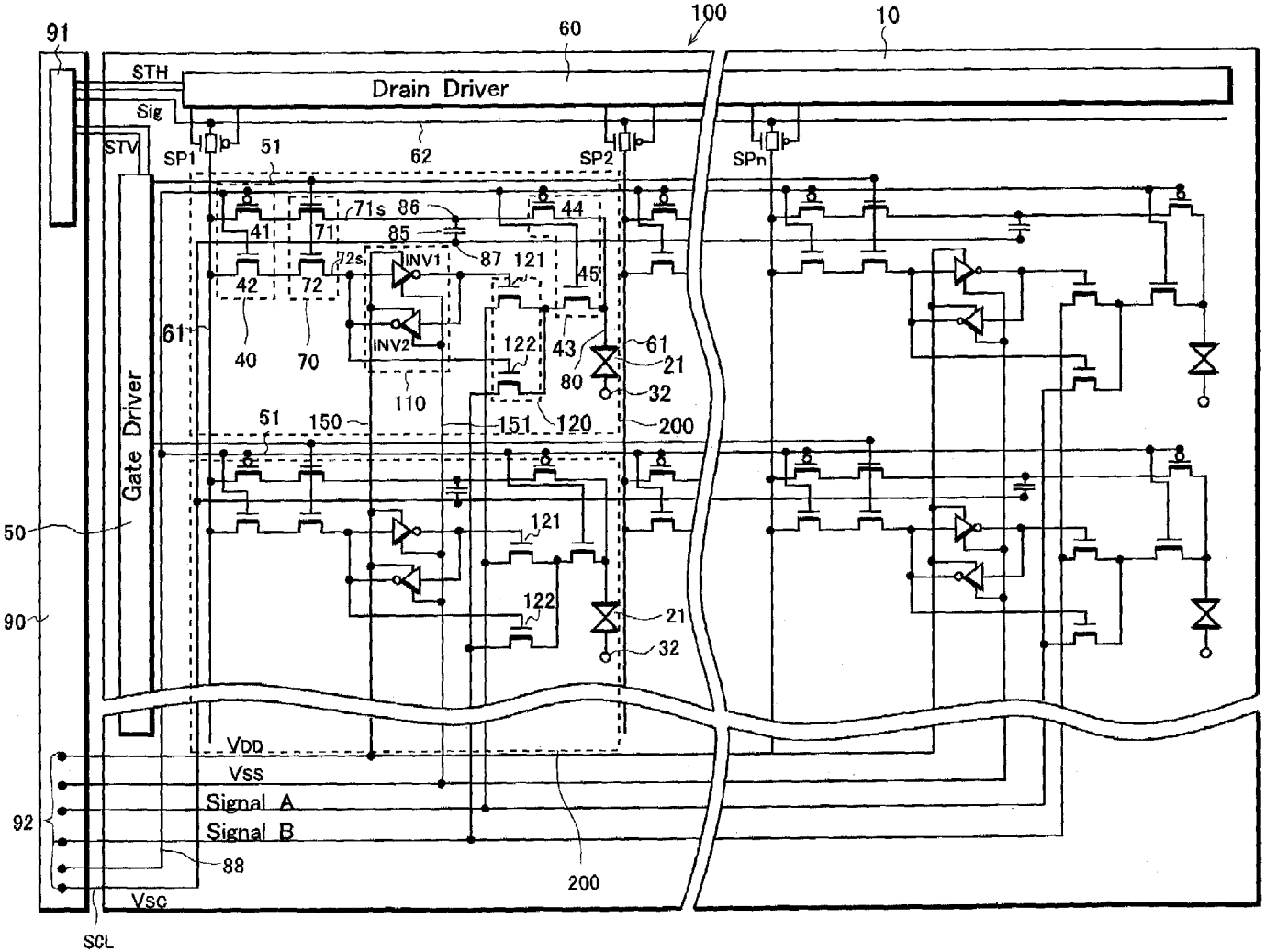
FIG. 3 is a circuit diagram of the liquid crystal display device of the embodiment of this invention.

Next, the configuration of the liquid crystal display device, especially the detailed configuration of the liquid crystal display panel 100, will be explained in reference to the circuit diagram in FIG. 3.

On an insulating board 10, a plurality of gate signal lines 51, connected to a gate driver 50 supplying a scanning signal, are disposed in one direction. A plurality of drain signal lines 61 are disposed in the direction perpendicular to the gate signal line 51.

In response to the timing of a sampling pulse outputted from a drain driver 60, the respective sampling transistors SP1, SP2, - - - SPn sequentially turn on, supplying the data signal (analog image signal or digital image signal) of a data signal line 62 to the drain signal line 61.

On a liquid crystal display panel 100, a plurality of pixel elements, disposed in a matrix configuration, are selected by the scanning signal fed from the gate signal line 51 and are provided with the data signal fed from the drain signal line 61.

The detailed configuration of a pixel element 200 will be explained hereinafter. Near the crossing of the gate signal line 51 and drain signal line 61, a circuit selection circuit 40 comprising a P channel TFT 41 and an N channel TFT 42 is formed. Both drains of the TFTs 41 and 42 are connected to the drain signal line 61 and both gates of these TFTs are connected to a circuit selection signal line 88. Either one of TFTs 41 or 42 turns on based on the selection signal from the circuit selection signal line 88. Also, as explained later, a circuit selection circuit 43 is formed, pairing with the circuit selection circuit 40.

Therefore, selecting, as well as changing, between the analog display mode (full color moving image) and the digital display mode (low energy consumption, still image) is possible. Also, a pixel element selection circuit 70 having an N channel TFT 71 and an N channel TFT 72 is formed adjacent to the circuit selection circuit 40. The pixel element selection TFTs 71 and 72 are connected to the circuit selection TFTs 41 and 42 of the circuit selection circuit 40 in the vertical direction, respectively. Also, both gates of the TFTs 71, 72 are connected to the gate signal line 51. Both of the TFTs 71 and 72 turn on simultaneously in response to the scanning signal fed from the gate signal line 51.

A storage capacitance element 85 holds the analog image signal under the analog mode. One electrode 86 of the storage capacitance element 85 is connected to the source 71s of the TFT 71. Another electrode 87 is connected to a common storage capacitance line CSL carrying a bias voltage VCS. When the analog image signal is applied to a liquid crystal 21 after the opening of the TFT gates of the circuit selection circuit 70, the voltage of the applied signal may decrease even during a one-field period, resulting in a loss of homogeneity of the display image. The storage capacitance element 85 maintains the applied voltage at the initial level during one field period for eliminating the problem above.

A P channel TFT 44 of the circuit selection circuit 43 is placed between the storage capacitance element 85 and the liquid crystal 21, and turns on and off in synchronization with the switching of the TFT 41 of the circuit selection circuit 43. A static memory circuit 110 and a signal selection circuit 120 are placed between the TFT 72 of the pixel element selection circuit 70 and a display electrode 80 of the liquid crystal 21.

The static memory circuit 110 has two inverter circuits, the first and second inverter circuits, which are positively fed back to each other. The source 72s of the pixel element selection TFT 72 is connected to an input terminal of the first inverter circuit INV1, and its output is inputted to the second inverter circuit INV2. Also, an output terminal of the second inverter circuit INV2 is connected to the input terminal of the first inverter circuit INV1.

Under the digital display mode, when the voltage of the circuit selection signal line 88 is "H", and when the scanning signal of the gate signal line 51 also is "H", the writing into the static memory circuit 110 is possible.

The signal selection circuit 120 is the circuit selecting the signal based on the digital image signal retained in the static memory circuit 110 and comprises two N-channel TFTs 121, and 122. To the gates of the TFTs 121, 122, the output signal is complimentarily supplied from the static memory circuit 110 and thus, the TFTs 121, 122 complimentarily turn on and off.

Here, the AC drive signal (signal B) is selected when the TFT 122 turns on, and the common electrode signal VCOM (signal A) is selected when the TFT 121 turns on. The selected signal is then applied to the display electrode 80, which supplied the voltage to the liquid crystal 21, through the TFT 45 of the circuit selection circuit 43.

The liquid crystal panel 100 has a peripheral circuit as well. An LSI 91 for driver scanning is mounted on an external circuit board 90 externally attached to the insulating substrate 10 of the liquid crystal panel 100, and sends a vertical start signal STV and a horizontal start signal STH to the gate driver 50 and the drain driver 60, respectively. The panel driver LSI also feeds the image signal to a data line 62.

Figure 4:
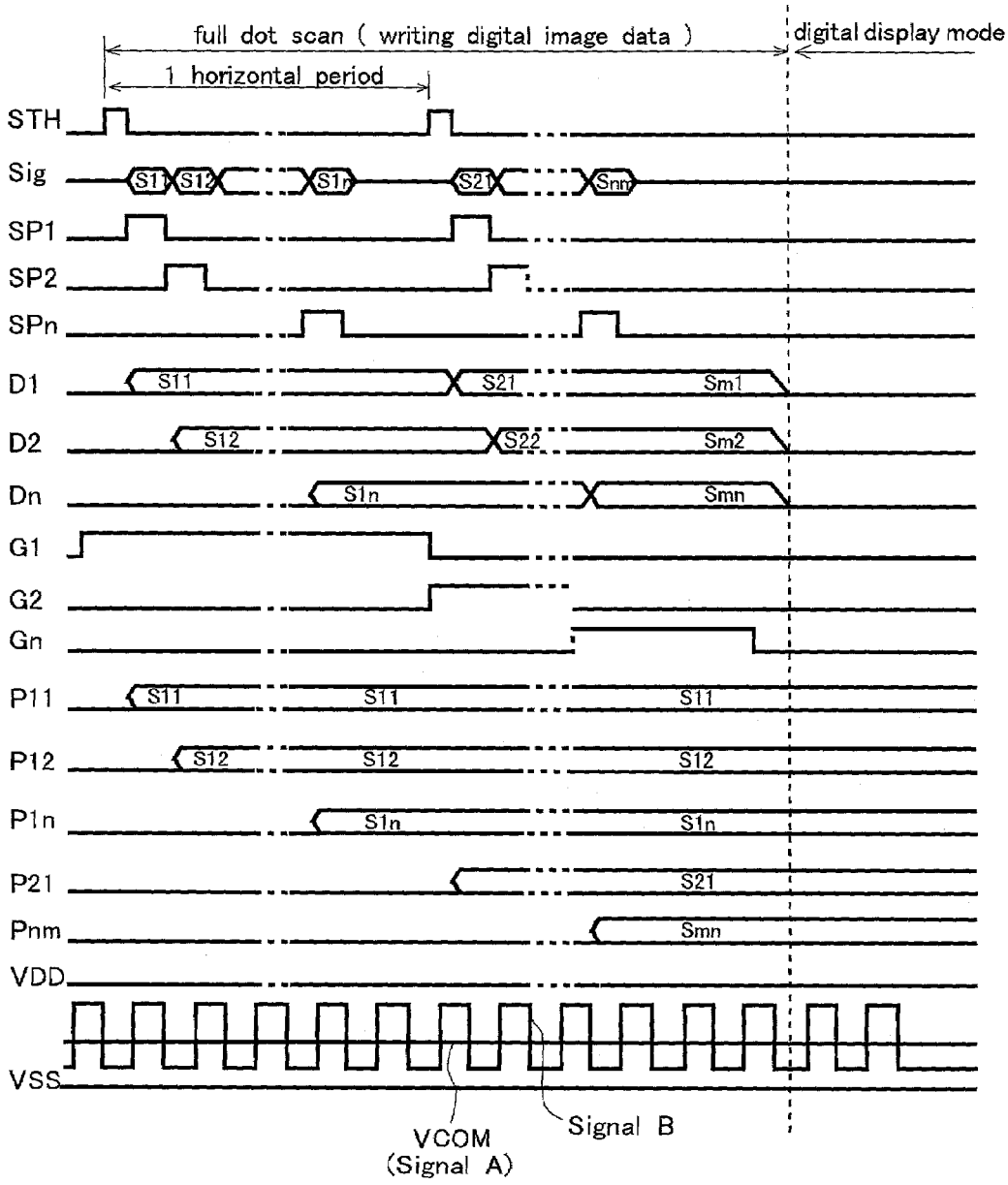
FIG. 4 is a timing chart of the liquid crystal display device under the digital display mode.
Figure 5:
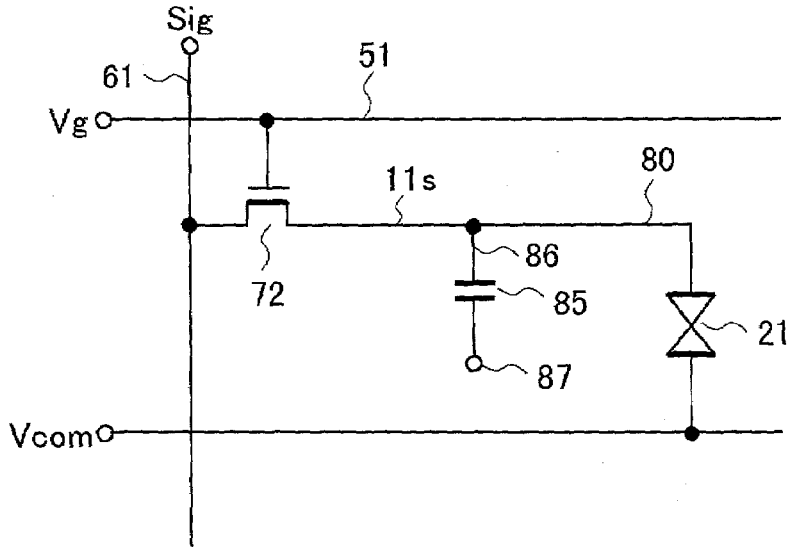
Fig.5 PRIOR ART
FIG. 5 is a circuit diagram of a conventional liquid crystal display device.
Figure 6:
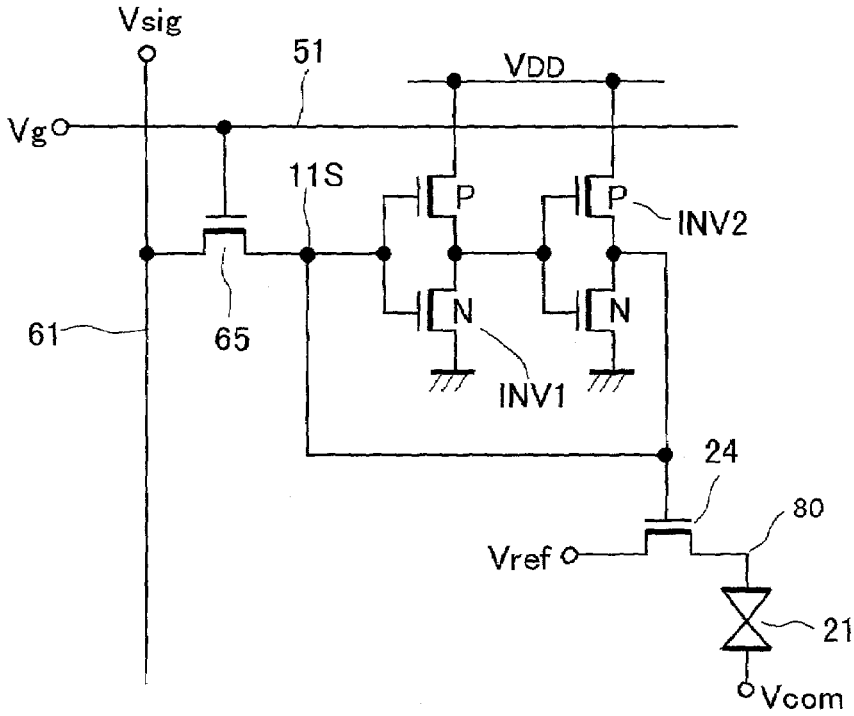
Fig.6 PRIOR ART
FIG. 6 is a circuit diagram of another conventional liquid crystal display device.

The driving method of the display device described above will be explained hereinafter in reference to FIGS. 3 and 4. FIG. 4 shows a timing chart when the liquid crystal display device is set to operate under the digital display mode.

(1) Analog Display Mode.

When the analog display mode is selected in response to the mode switching signal MD, the analog image signal is outputted to the data signal line 62 from the DA converter 3. Also, the voltage applied to the circuit selection signal line 88 changes to "L", so that the TFTs 41, 44 of the circuit selection circuits 40, 43 turn on.

The sampling transistor SP turns on in response to the sampling signal based on the horizontal start signal STH so that the analog image signal of the data signal line 62 is supplied to the drain signal line 61. The sampling signal corresponds to the panel drive signal and its frequency is 60 Hz under the analog display mode.

Also, the scanning signal is supplied to the gate signal line 51 in accordance with the vertical start signal STV. When the TFT 71 turns on in response to the scanning signal, the analog image signal Sig is applied, through the drain signal line 61, to the display electrode 80 and the storage capacitance element 85, which holds the applied voltage. The liquid crystal 21 aligns itself in accordance with the image signal voltage applied to the liquid crystal 21 fed from the display electrode 80, to form a display image.

The analog display mode is suitable for showing a full color moving picture.

(2) Digital Display Mode

When the digital display mode is selected in response to the mode switching signal MD, the data signal line 62 is set to receive the digital image signal outputted from the frame memory 2. At the same time, the voltage of the circuit selection signal line 88 turns to "H", and the static memory circuit 110 is set to be operable. Further, the TFTs 41, 44 of the circuit selection circuits 40,43 turn off and the TFTs 42, 45 turn on.

The LSI 91 for driver scanning on the external circuit board 90 sends start signals STV, STH to the gate driver 50 and the drain driver 60, respectively. In response to the start signals, the sampling signals are sequentially generated and turn on the respective sampling transistors SP1, SP2, - - - SPn sequentially, which sample the digital image signal Sig and send it to each of the drain signal lines 61.

The operation of the first row of the matrix, or the operation of the gate signal line 51, which receives the scanning signal G1, will be described below. First, the scanning signal G1 turns on each TFT of the pixel elements, P11, P12, - - - P, in connected to the gate signal line 51, for one horizontal scanning period.

In the pixel element P11 located at the upper left corner of the matrix, the sampling signal SP1 allows an intake of the digital image signal S11 and feeds it to the drain signal line 61. The scanning signal G1 becomes "H", turning the TFT 70 on. Thus, the drain signal D1 is written into the static memory circuit 110.

Under the digital display mode, the frequency of the sampling signal is reduced to 20–30 Hz by the timing control circuit 6 described above. Therefore, it is possible to write the signal into the static memory circuit 110 without amplifying it using a level shifter The signal retained by the static memory circuit 110 is then fed to the signal selection circuit 120, and the signal selection circuit 120 selects either signal A or signal B. The selected signal is then applied to the liquid crystal 21 through the display electrode 80. Thus, upon completion of a scanning from the first gate signal line 51 on the top row of the matrix to the last gate signal line 51 on the bottom row of the matrix, a full display frame scan (one field scan) is completed.

Then, the display in accordance with the data held in the static memory circuit 110 (still picture display) appears. Under this digital display mode, the supply of the power voltage to the circuits such as the gate driver 50, the drain driver 60 and the external LSI 91 for driver scanning is halted. In the meantime, the static memory circuit 110 continuously receives the voltages VDD, VSS. Also, the common electrode 32 receives the common electrode voltage and the signal selection circuit 120 receives signal A and signal B.

That is, when the static memory circuit 110 receives the VDD, VSS for its operation and when the common electrode voltage VCOM (signal A) is applied to the common electrode, the liquid crystal display panel 100 is in the normally-white (NW) mode. In this mode, the same voltage as the common electrode 32 is applied to the signal A and only the AC drive voltage (for example 60 HZ) for driving the liquid crystal is applied to the signal B.

In this way, the data for one still picture is retained and displayed. Other circuits, such as the gate driver 50, the drain driver 60 and the external LSI 91 for driver scanning do not receive any voltage.

When the static memory circuit 110 receives the digital image signal of "H (high)" through the drain signal line 61, the first TFT 121 of the signal selection circuit 120 receives an "L" signal and accordingly turns off, and the second TFT 122 receives an "H" signal and turns on.

In this case, the signal B is selected and the liquid crystal 21 receives the signal B having a phase opposite to the signal A applied to the common electrode 32, resulting in the rearrangement of the liquid crystal 21. Since the display panel is in an NW mode, a black image results.

When the static memory circuit 110 receives the digital image signal of "L" through the drain signal line 61, the first TFT 121 of the signal selection circuit 120 receives an "H" signal and accordingly turns on The second TFT 122 receives an "L" signal and turns off. In this case, the signal A is selected and the liquid crystal 21 receives the signal A, which has the same voltage applied to the common electrode 32. As a result, there is no change in the arrangement of the liquid crystal 21 and the pixel element stays white.

In the explanation about the above embodiment, one-bit digital data signal is inputted in the digital display mode. However, this invention is not limited to that embodiment, and is also applicable to multiple-bit data signal system. In such a configuration, a multiple-level image representation is possible. Also, in such a configuration, it is necessary to provide the retaining circuits and the signal selection circuits in accordance with the number of the bits used in the system.

In the display device of this invention, the digital image signal can be written into the static memory circuit from the image memory without shifting the amplitude of the signal by reducing the frequency of the panel drive signal. That is, the level shifter for amplifying the digital image signal fed from the image memory is not needed. This reduces the circuit size. It is also possible to put the analog signal processing element and the digital signal processing circuit together on one chip.

The above is a detailed description of the particular embodiment of the invention which is not intended to limit the invention to the embodiment described. It is recognized that modifications within the scope of the invention will occur to a person skilled in the art. Such modifications and equivalents of the invention are intended for inclusion within the scope of this invention.

What is claimed is:

1. A display device comprising:

a display panel;

an image memory outputting a digital image signal;

a plurality of pixel elements disposed in the display panel;

a plurality of static memory circuits disposed corresponding to the pixel elements; and a panel drive circuit supplying a panel drive signal for controlling a timing of writing the digital image signal into the static memory circuits, wherein an image is displayed at a frequency of the panel drive signal based on the digital image signal retained in the static memory circuits, and the digital image signal is written into the static memory circuits from the image memory by reducing the frequency of the panel drive signal without using a level-shifter for raising a level of the digital image signal.

2. A display device comprising:

a display panel;

an image memory outputting a digital image signal;

a DA converter converting the digital image signal outputted from the image memory into an analog image signal;

a signal selection element selecting the analog image signal from the DA converter or the digital image signal outputted from the image memory, the selected signal being supplied to the display panel;

a timing control circuit supplying a panel drive signal to the display panel;

a plurality of pixel elements disposed in the display panel;

a plurality of first display circuits disposed corresponding to the pixel elements and displaying an analog image in response to the analog image signal inputted based on the panel drive signal; and a plurality of second display circuits disposed corresponding to the pixel elements and displaying a digital image in response to the digital image signal, each of the second display circuits having a static memory circuit which receives the digital image signal based on the panel drive signal, wherein the first display circuit or the second display circuit is selected for displaying the analog image or the digital image at a frequency of the panel drive signal, respectively, and the timing control circuit reduces the frequency of the panel drive signal so that the digital image signal is written into the static memory circuit from the image memory without using a level-shifter for raising a level of the digital image signal.

3. The display device of claim 2, wherein the reduced frequency of the panel drive signal which is used when one of the second display circuits is selected is lower than a frequency of the panel drive signal which is used when one of the first display circuits is selected.

4. The display device of claim 1 or 3, wherein the static memory circuit comprises a first inverter circuit and a second inverter circuit positively feeding back to each other.

5. The display device of claim 4, wherein the first inverter circuit and the second inverter circuit comprise a thin film transistor.

6. A method of displaying a digital image signal on a display device comprising:

providing a display panel;

providing an image memory outputting a digital image signal;

providing a plurality of pixel elements disposed in the display panel;

providing a plurality of static memory circuits disposed the corresponding to the pixel elements;

supplying a panel drive signal controlling a timing of writing the digital image signal into the static memory circuits from a panel drive circuit;

writing the digital image signal into the static memory circuits from the image memory at a first frequency of the panel drive signal without using a level-shifter for raising a level of the digital image signal; and displaying an image based on the digital image signal retained in the static memory circuits at a second frequency of the panel drive signal that is higher than the first frequency.

* * * * *